US009790933B2

(12) United States Patent
Park

(10) Patent No.: US 9,790,933 B2
(45) Date of Patent: Oct. 17, 2017

(54) VACUUM APPARATUS

(71) Applicant: BORU INTERNATIONAL CO., LTD., Yongin-si, Gyeonggi-do (KR)

(72) Inventor: Jun Young Park, Busan (KR)

(73) Assignee: BORU INTERNATIONAL CO., LTD., Gyeonggi-do (KR)

( * ) Notice: Subject to any disclaimer, the term of this patent is extended or adjusted under 35 U.S.C. 154(b) by 517 days.

(21) Appl. No.: 14/383,142

(22) PCT Filed: Feb. 15, 2013

(86) PCT No.: PCT/KR2013/001215
§ 371 (c)(1),
(2) Date: Sep. 5, 2014

(87) PCT Pub. No.: WO2013/137564
PCT Pub. Date: Sep. 19, 2013

(65) Prior Publication Data

US 2015/0052855 A1 Feb. 26, 2015

(30) Foreign Application Priority Data

Mar. 16, 2012 (KR) ..... 10-2012-0027317

(51) Int. Cl.
*B65B 31/04* (2006.01)
*F04B 9/14* (2006.01)
(Continued)

(52) U.S. Cl.
CPC ..... *F04B 9/14* (2013.01); *B65B 31/04* (2013.01); *F04B 33/00* (2013.01); *F04B 37/16* (2013.01)

(58) Field of Classification Search
CPC ..... B65B 31/04; B65B 31/041; B65B 31/042; B65B 31/046–31/048; F04B 33/00;
(Continued)

(56) References Cited

U.S. PATENT DOCUMENTS 3,486,663 A * 12/1969 Humphrey ..... B05B 11/3032 222/207
3,635,607 A * 1/1972 Grise ..... F04B 43/10 417/394
(Continued)

FOREIGN PATENT DOCUMENTS

DE WO 2011127929 A1 * 10/2011 ..... F02M 37/16
JP 2000-300445 A 10/2000
(Continued)

*Primary Examiner* — Stephen F Gerrity
*Assistant Examiner* — Joshua Kotis
(74) *Attorney, Agent, or Firm* — Roberts Mlotkowski Safran Cole & Calderon P.C.

(57) ABSTRACT

Disclosed is a vacuum apparatus that is not complicated in construction, does not require two receptacle bodies, and is improved in vacuum efficiency. The vacuum apparatus includes a cylinder member provided with a guide shaft disposed in the central area of the inner space thereof, and a piston module including a separating and opening/closing unit and a hollow rod unit with a guide bore in the inside thereof extending downward from the central area of the separating and opening/closing unit. The piston module is fitted in the inside of the cylinder member to separate the inner space of the cylinder member into an upper first space and a lower second space, and provided with a first O-ring to open/close the first space and the second space in relation to each other while being moved vertically according to a moving direction in relation to the cylinder member.

11 Claims, 18 Drawing Sheets

(51) Int. Cl.
*F04B 33/00* (2006.01)
*F04B 37/16* (2006.01)

(58) Field of Classification Search
CPC ..... F04B 33/005; F04B 37/10–37/20; F04B 9/14; F04B 45/02; B65D 81/20–81/2038
USPC ..... 53/510, 512, 408; 141/65; 417/460, 461, 417/545–554
See application file for complete search history.

(56) References Cited

U.S. PATENT DOCUMENTS 4,272,228 A * 6/1981 Kutik ..... A47K 5/16 222/321.7
4,278,114 A * 7/1981 Ruberg ..... A23L 3/0155 137/565.25
4,462,767 A * 7/1984 Dorsch ..... F04B 33/00 222/401
4,739,904 A * 4/1988 Spencer ..... B05B 11/3015 222/109
5,494,410 A * 2/1996 Maier-Laxhuber ..... F04B 33/00 417/259
7,296,598 B2 11/2007 Lin et al.
2006/0034719 A1* 2/2006 Chen ..... F04B 33/005 417/569
2007/0148014 A1* 6/2007 Anex ..... A61M 5/14526 417/392
2009/0238702 A1* 9/2009 Blythe ..... F04B 33/00 417/555.1

FOREIGN PATENT DOCUMENTS

KR 20-0408522 Y1 2/2006
KR 10-0991304 B1 11/2010

* cited by examiner

【Figure 1】
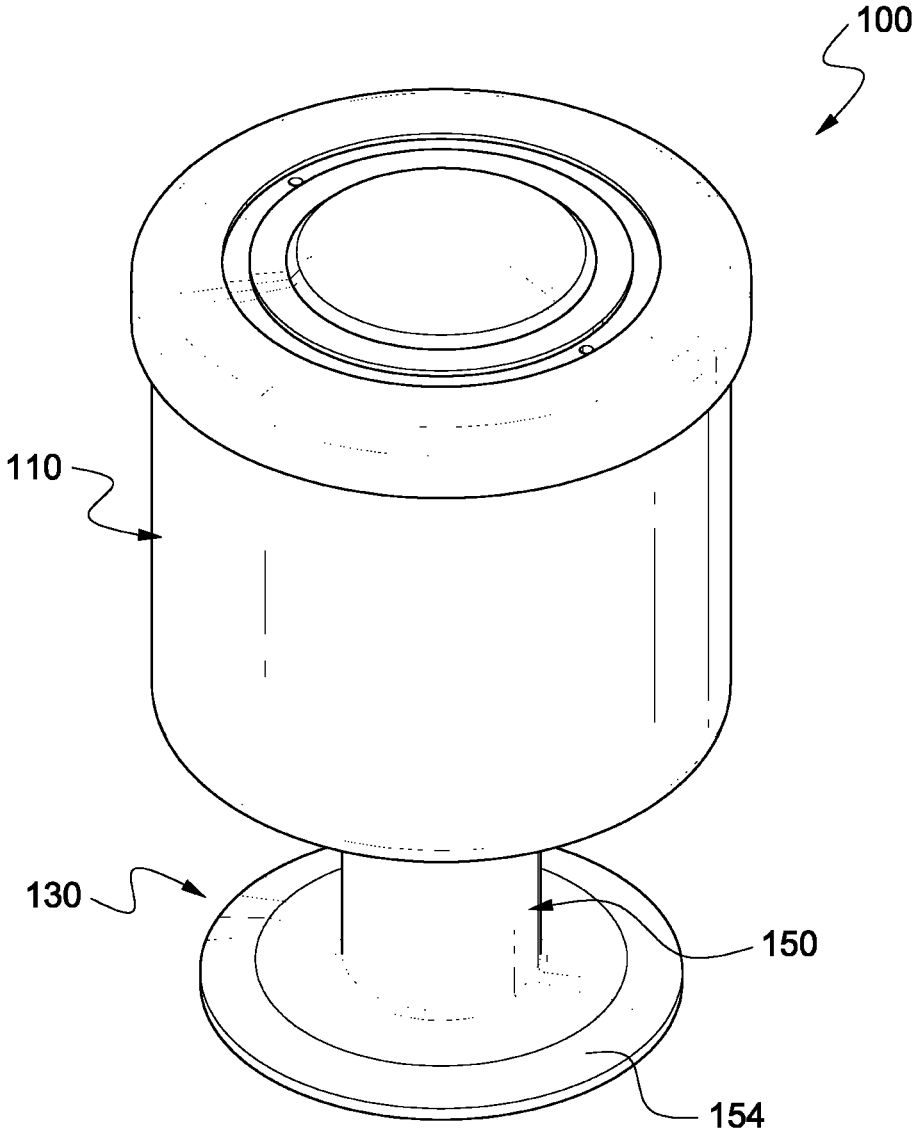

【Figure 2】
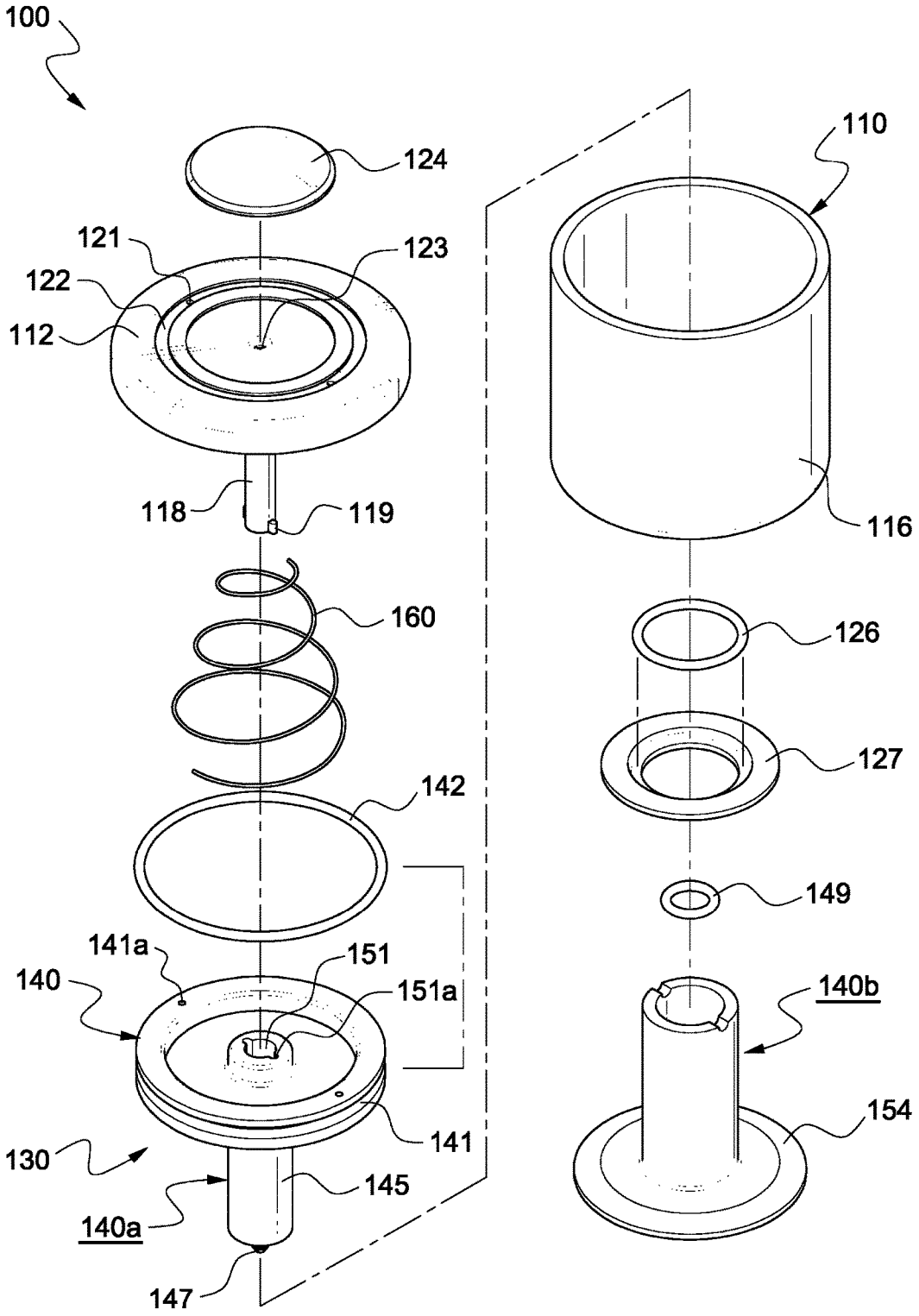

【Figure 3】
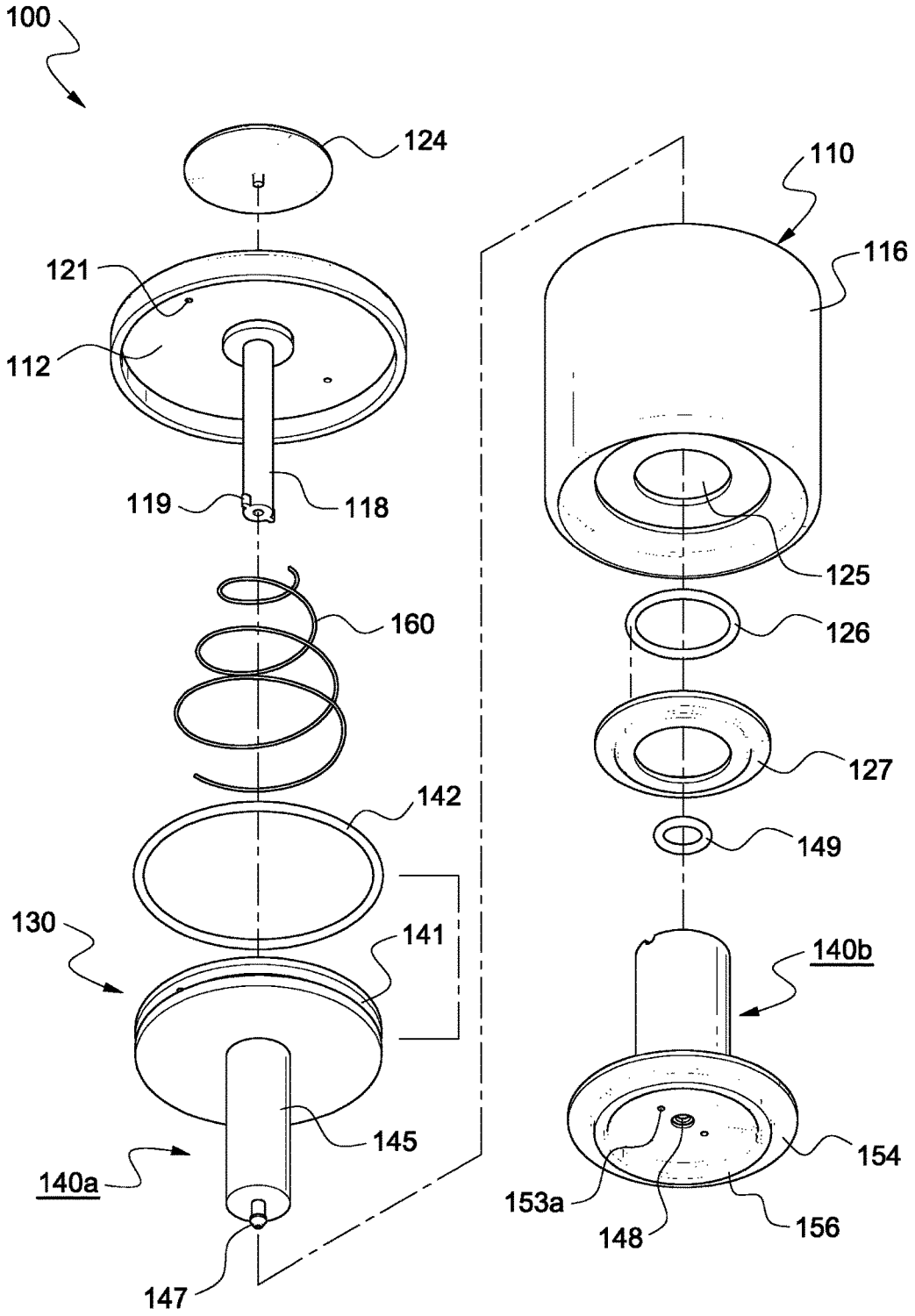

【Figure 4】
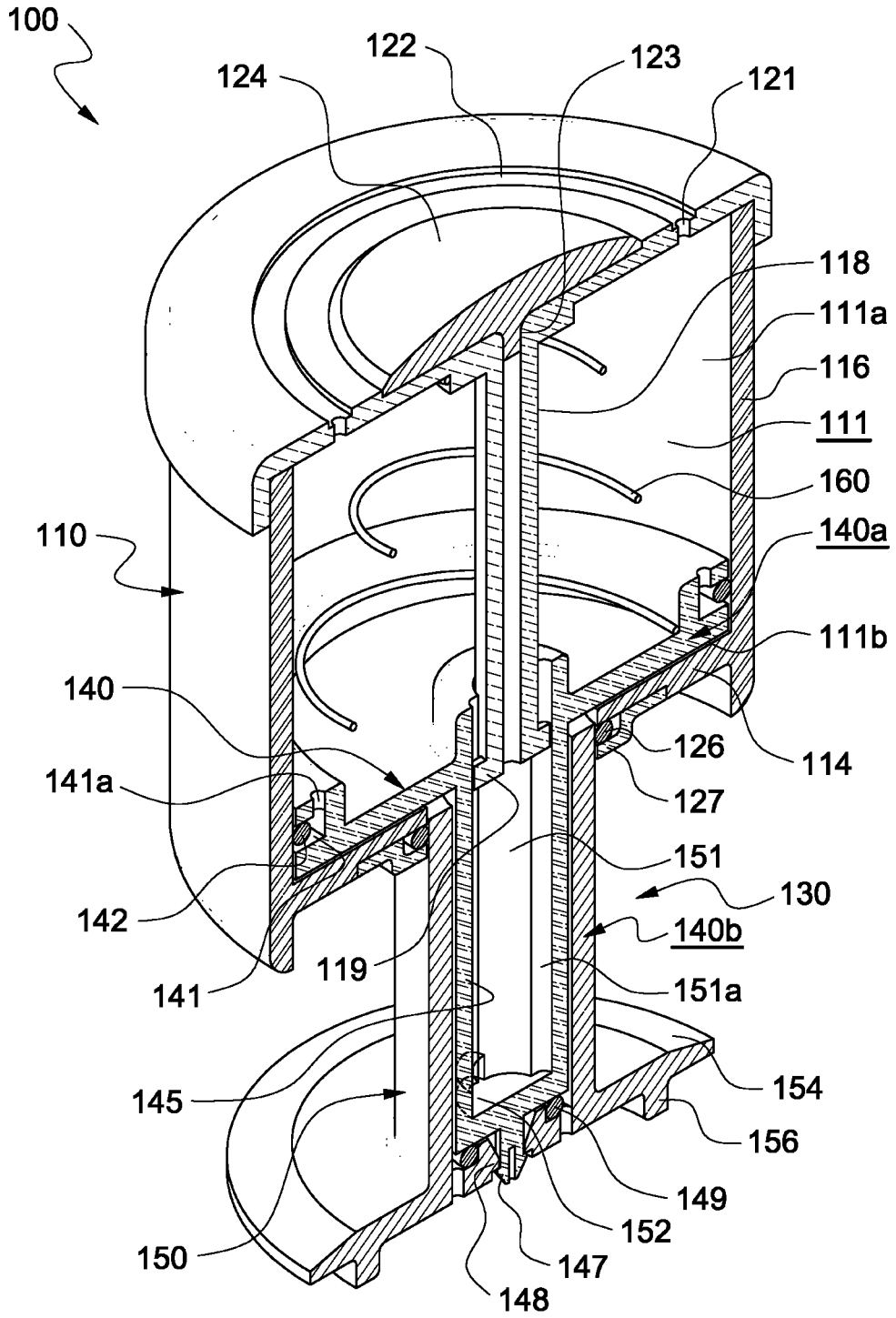

【Figure 5】
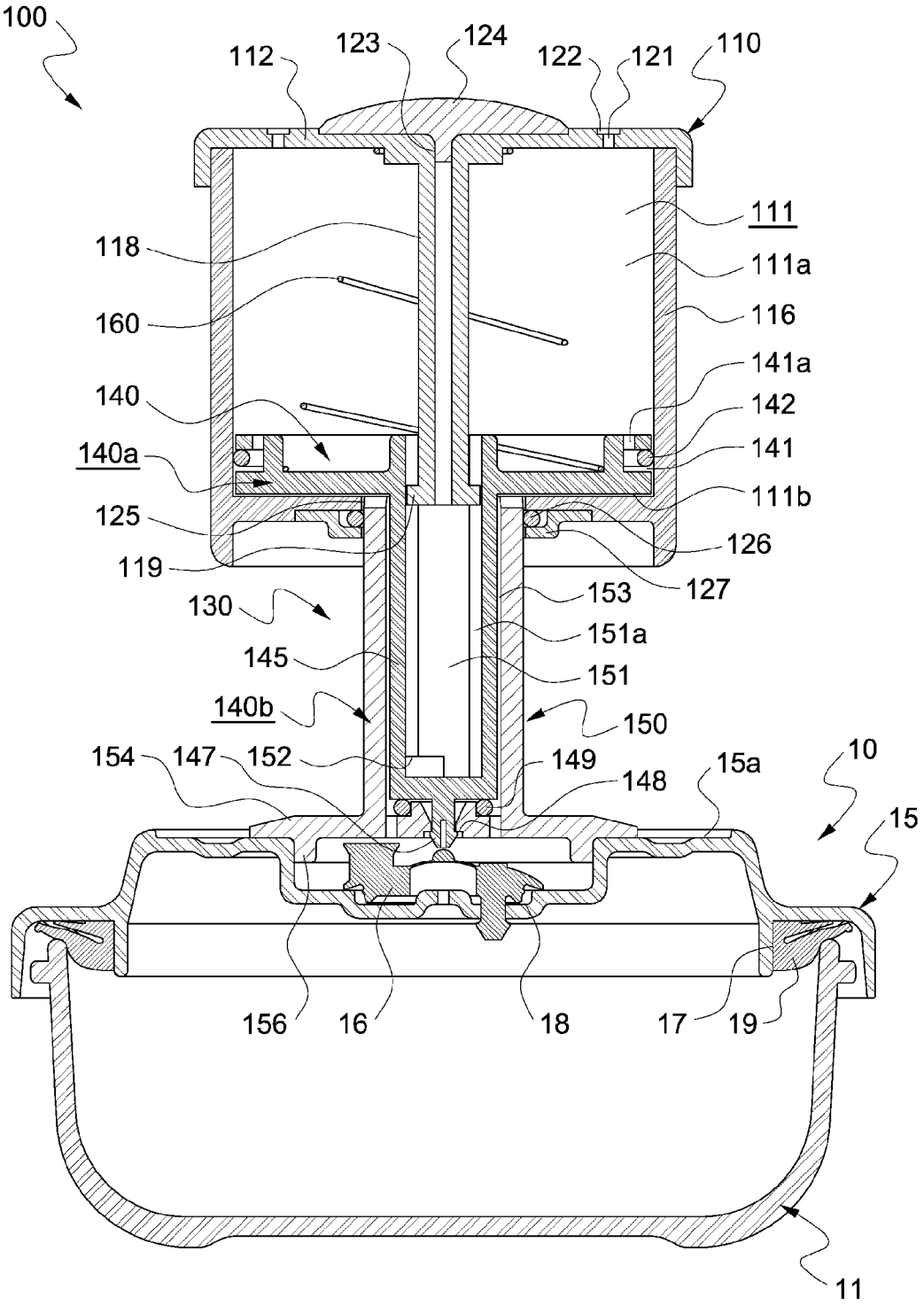

【Figure 6】
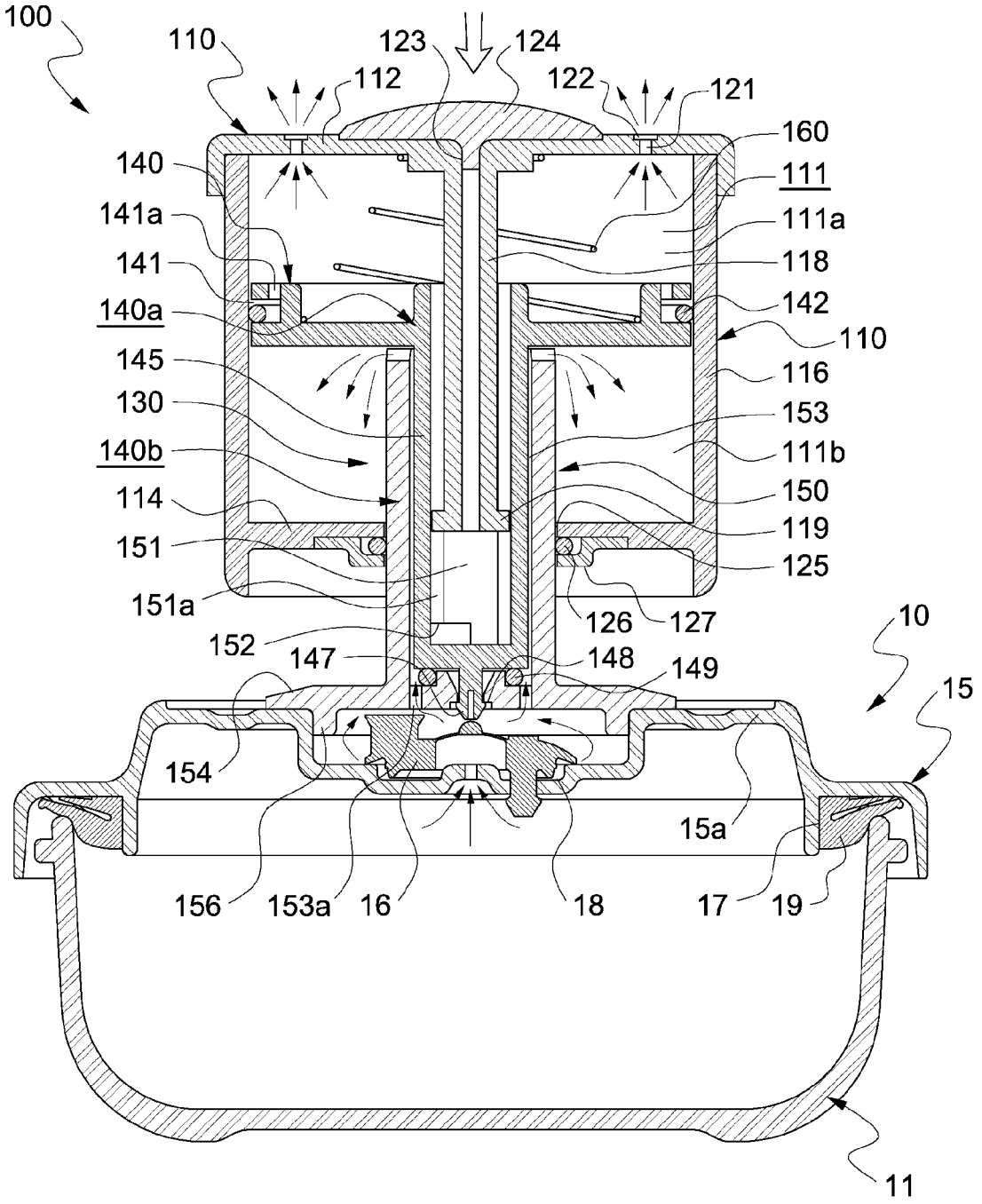

【Figure 7】
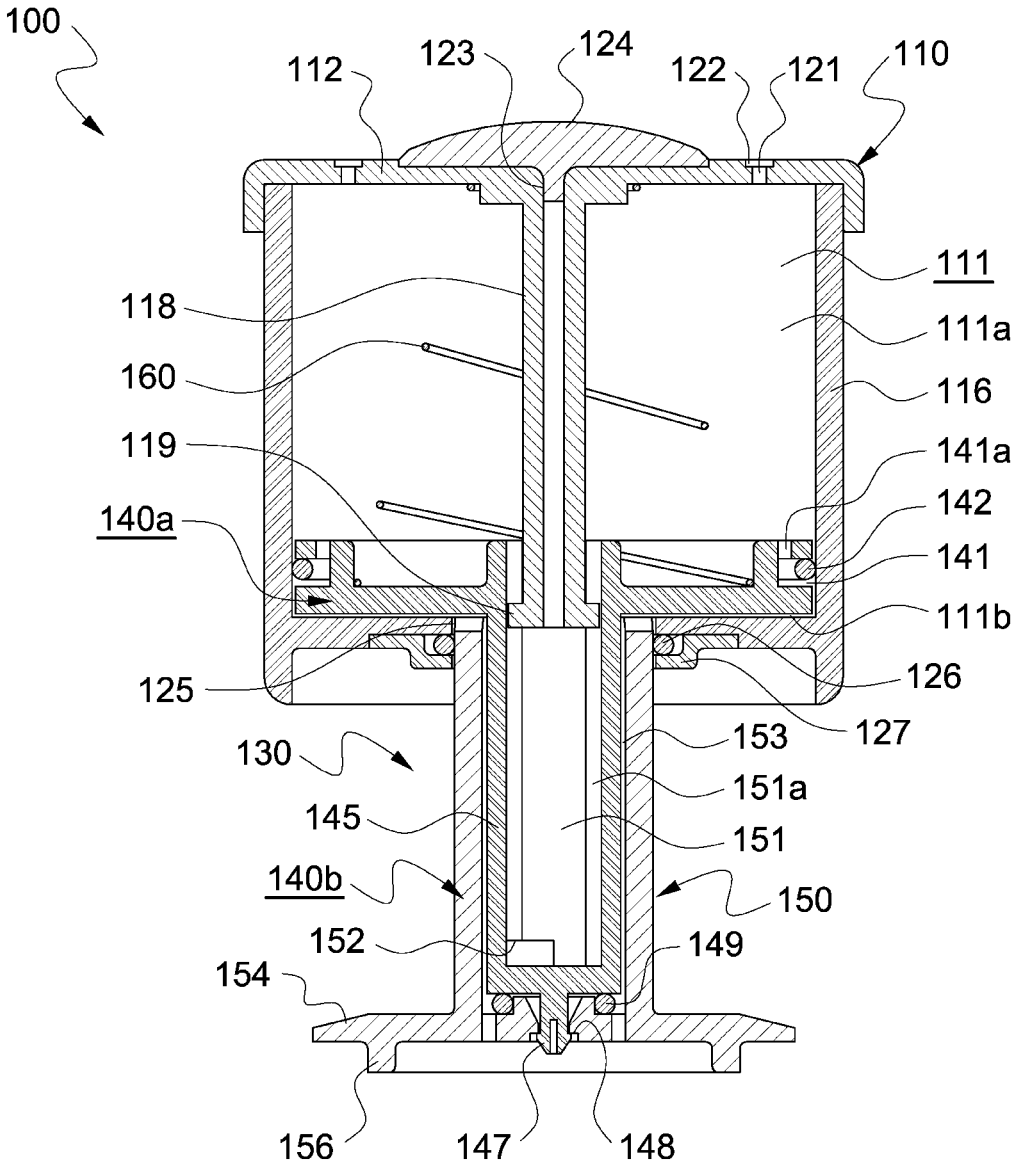

【Figure 8】
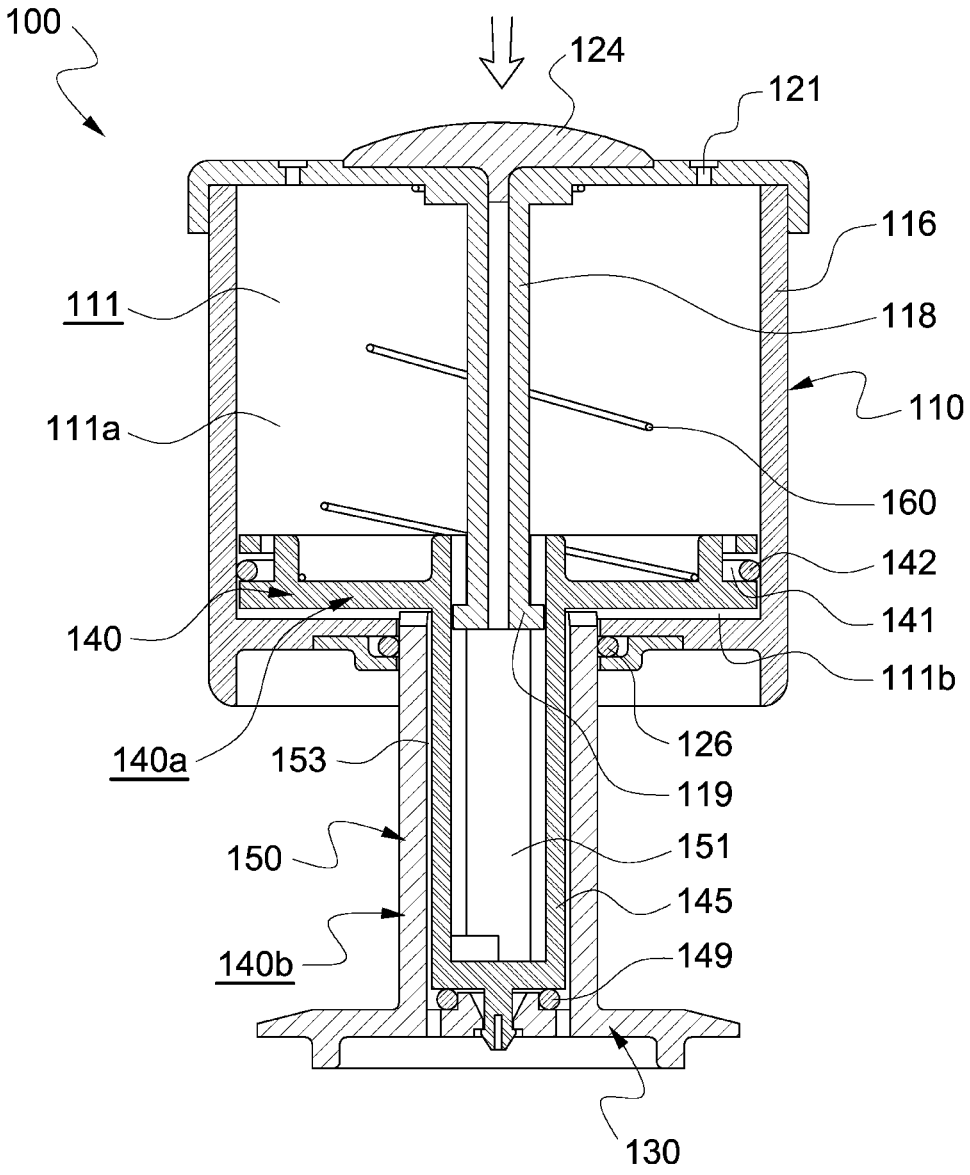

【Figure 9】
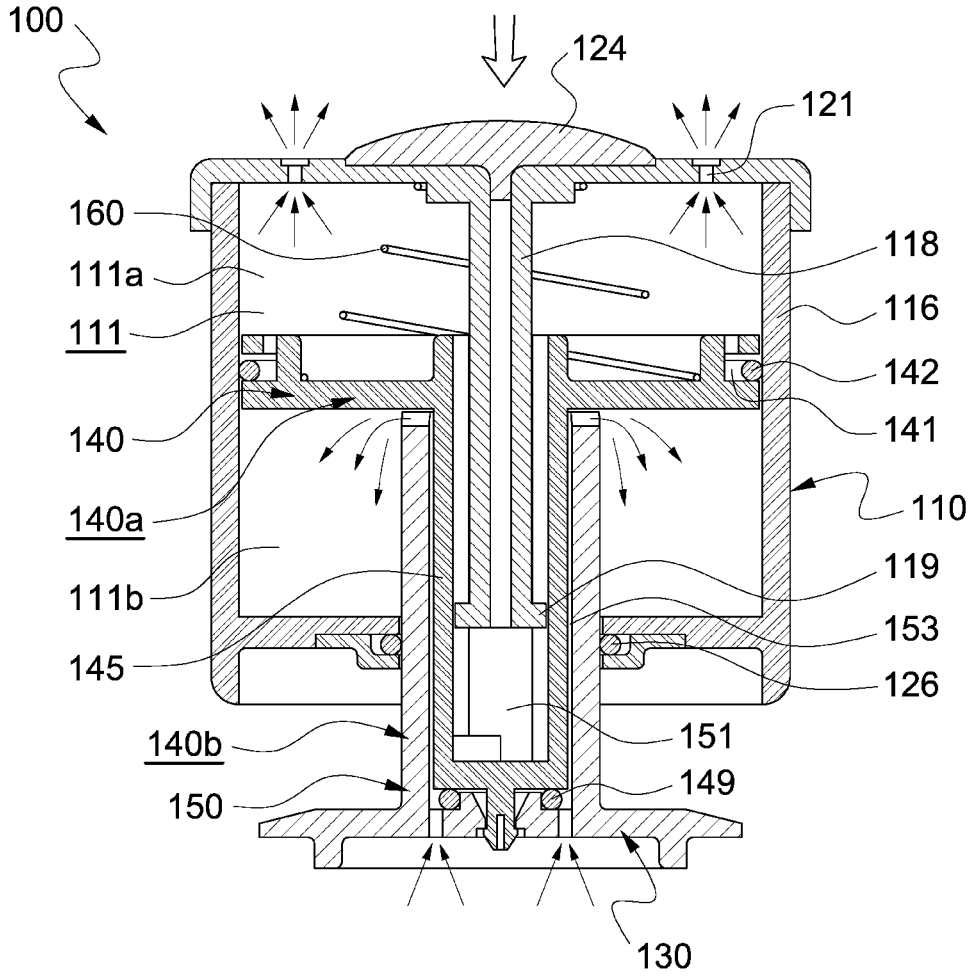

【Figure 10】
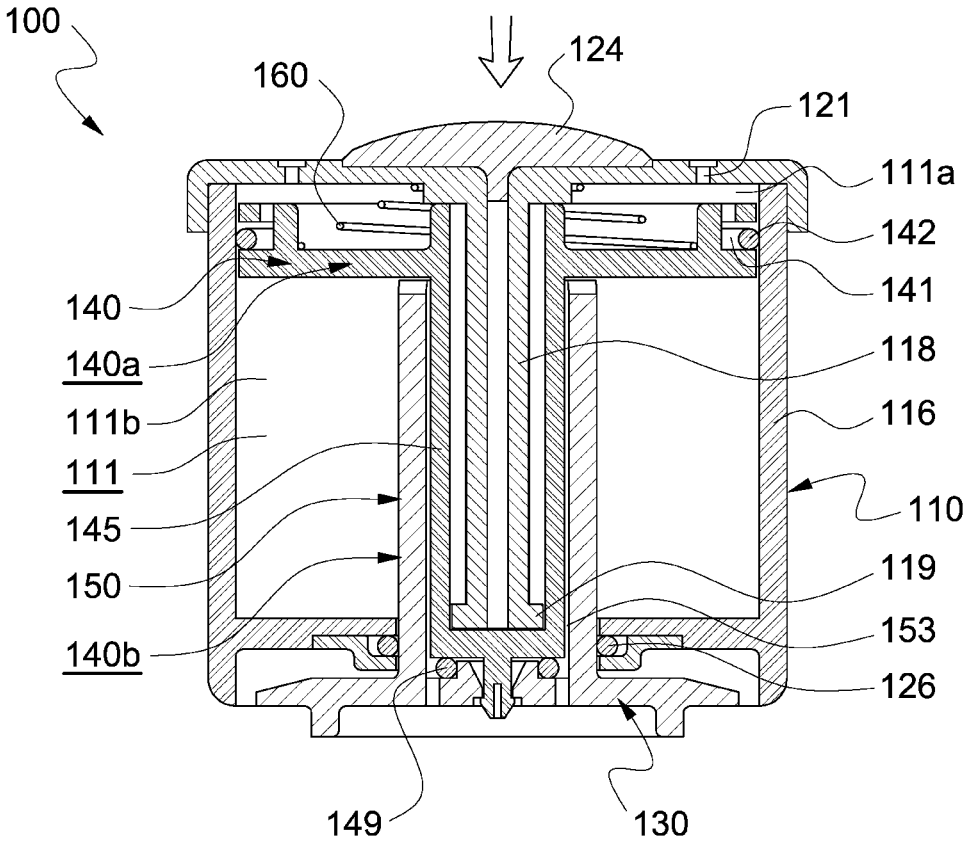

【Figure 11】
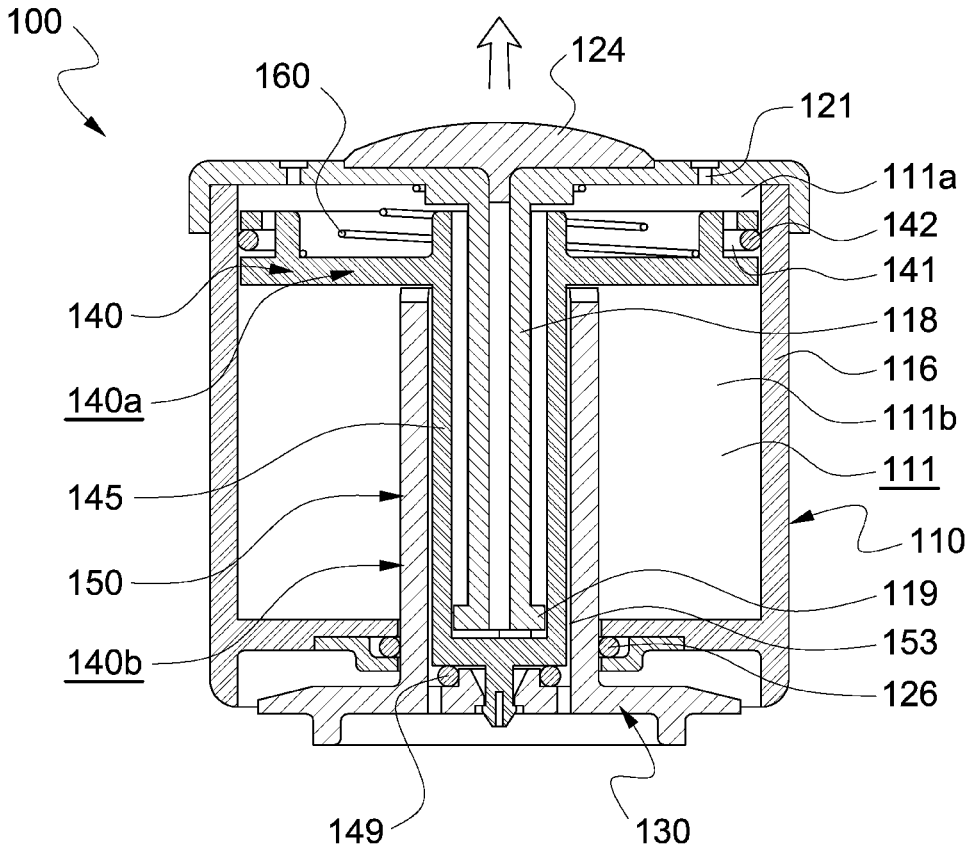

【Figure 12】
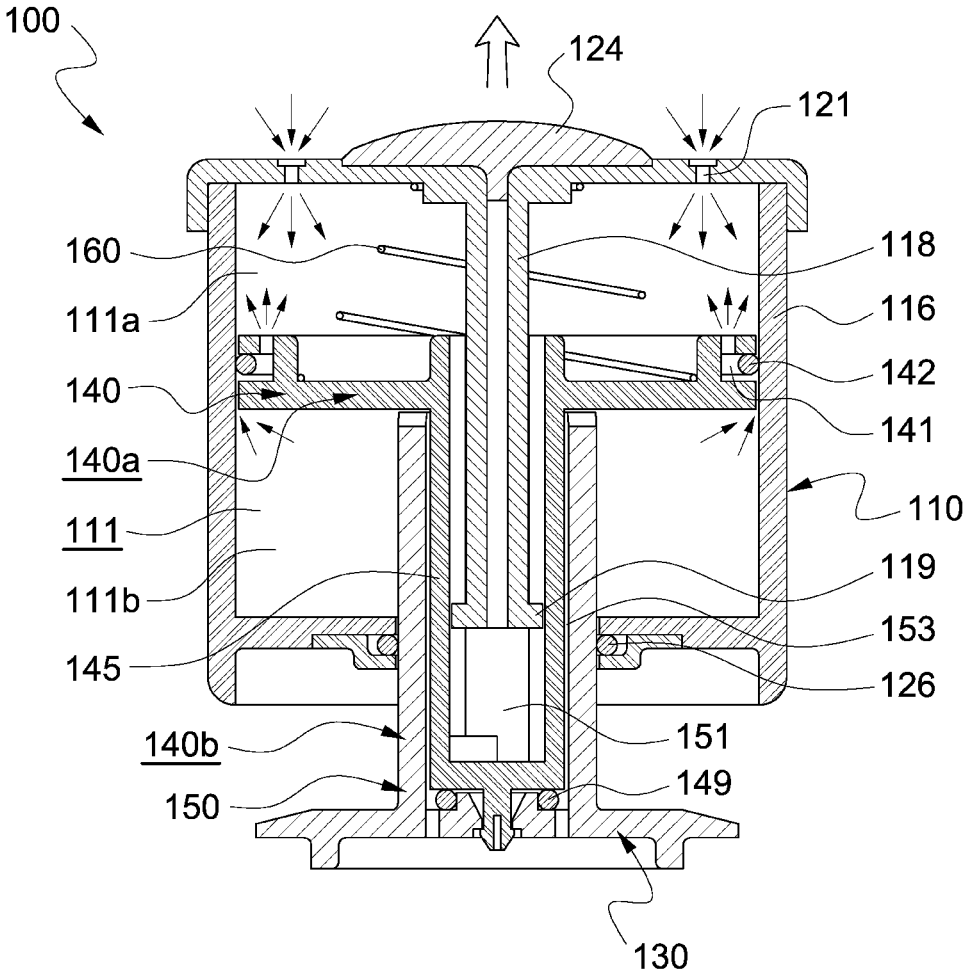

【Figure 13】
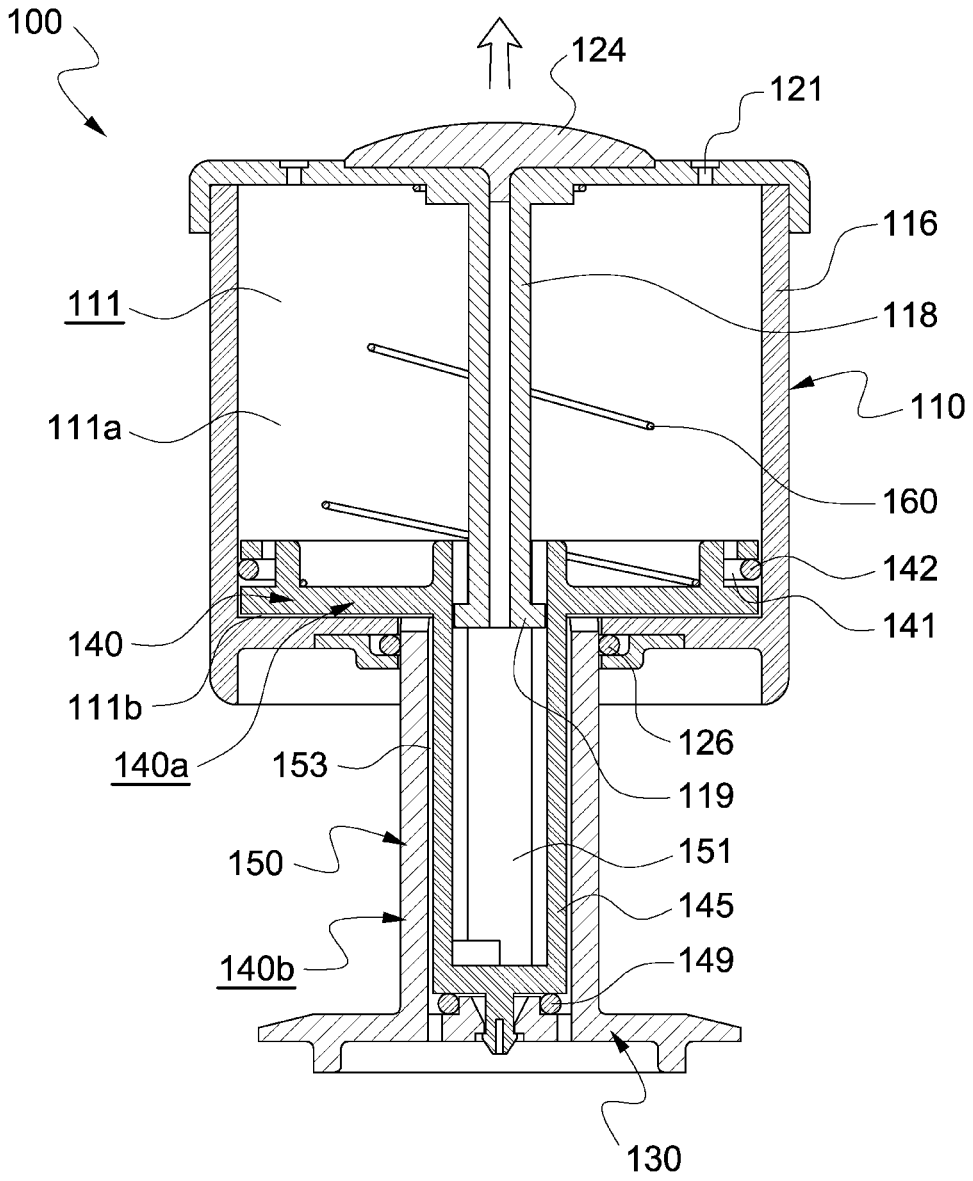

【Figure 14】
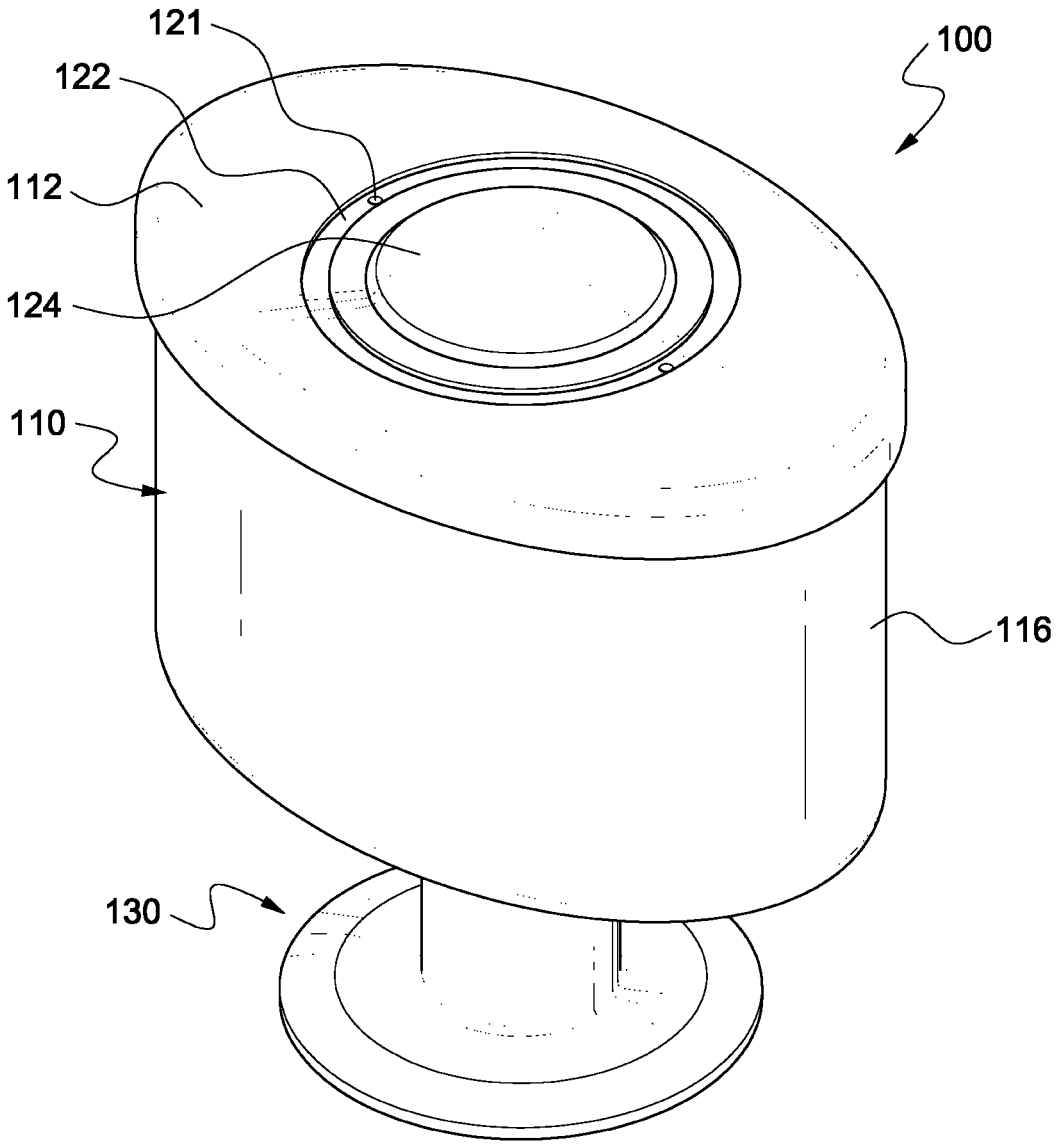

【Figure 15】
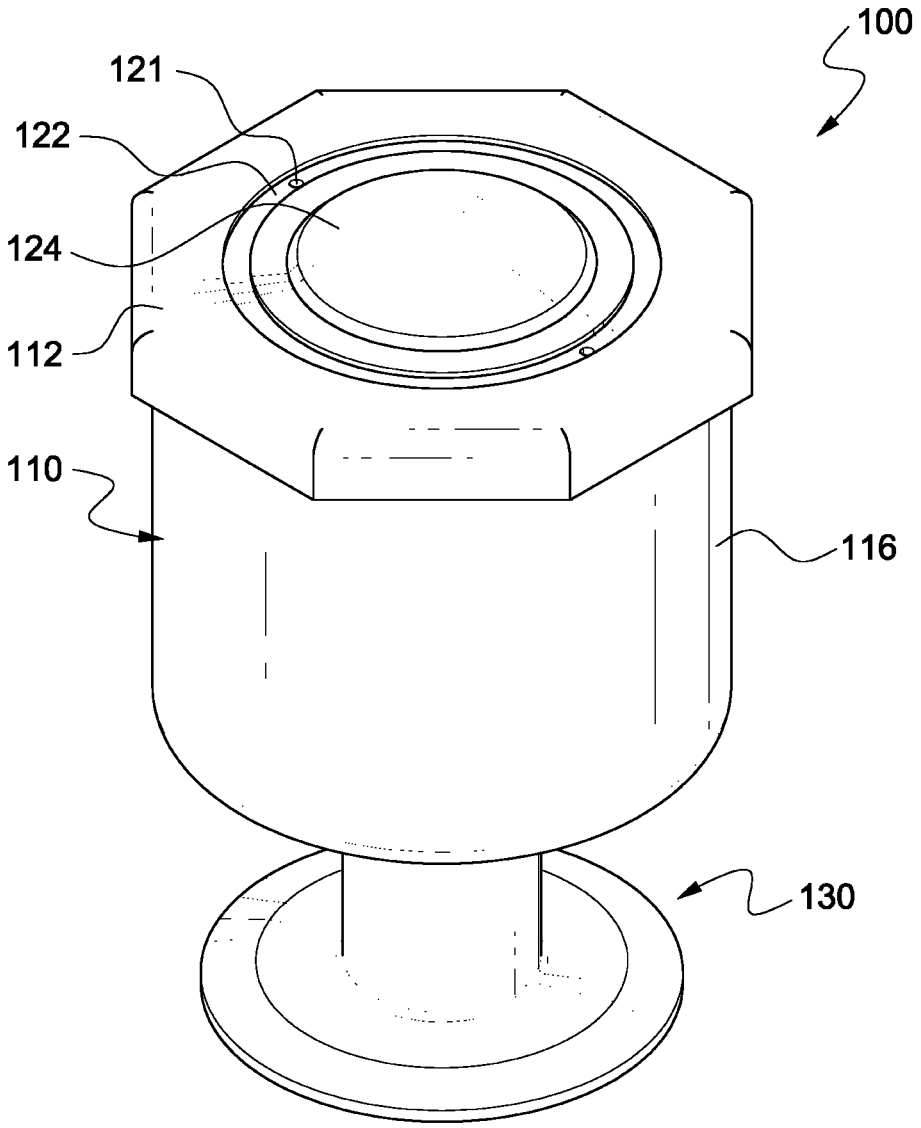

【Figure 16】
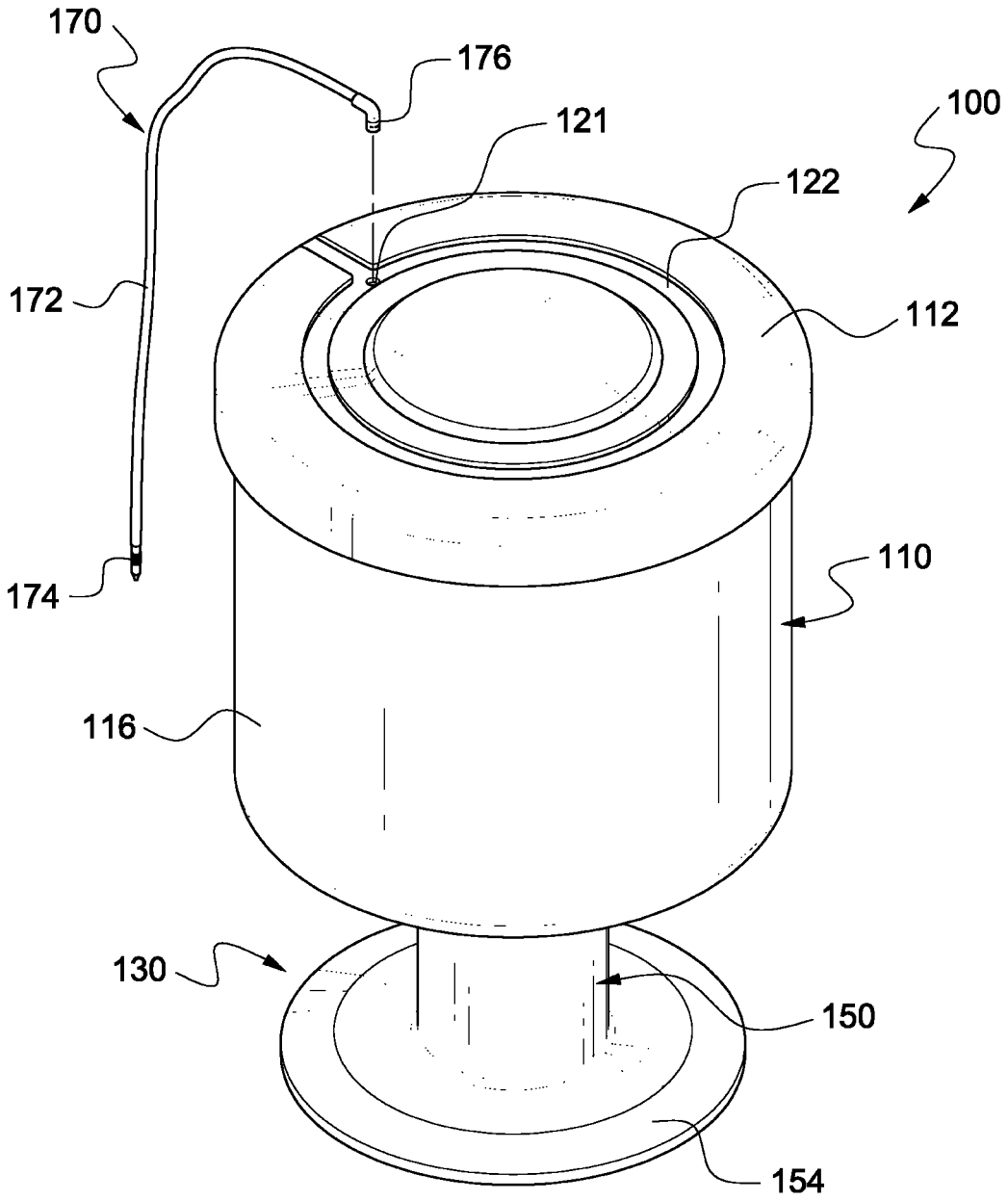

【Figure 17】
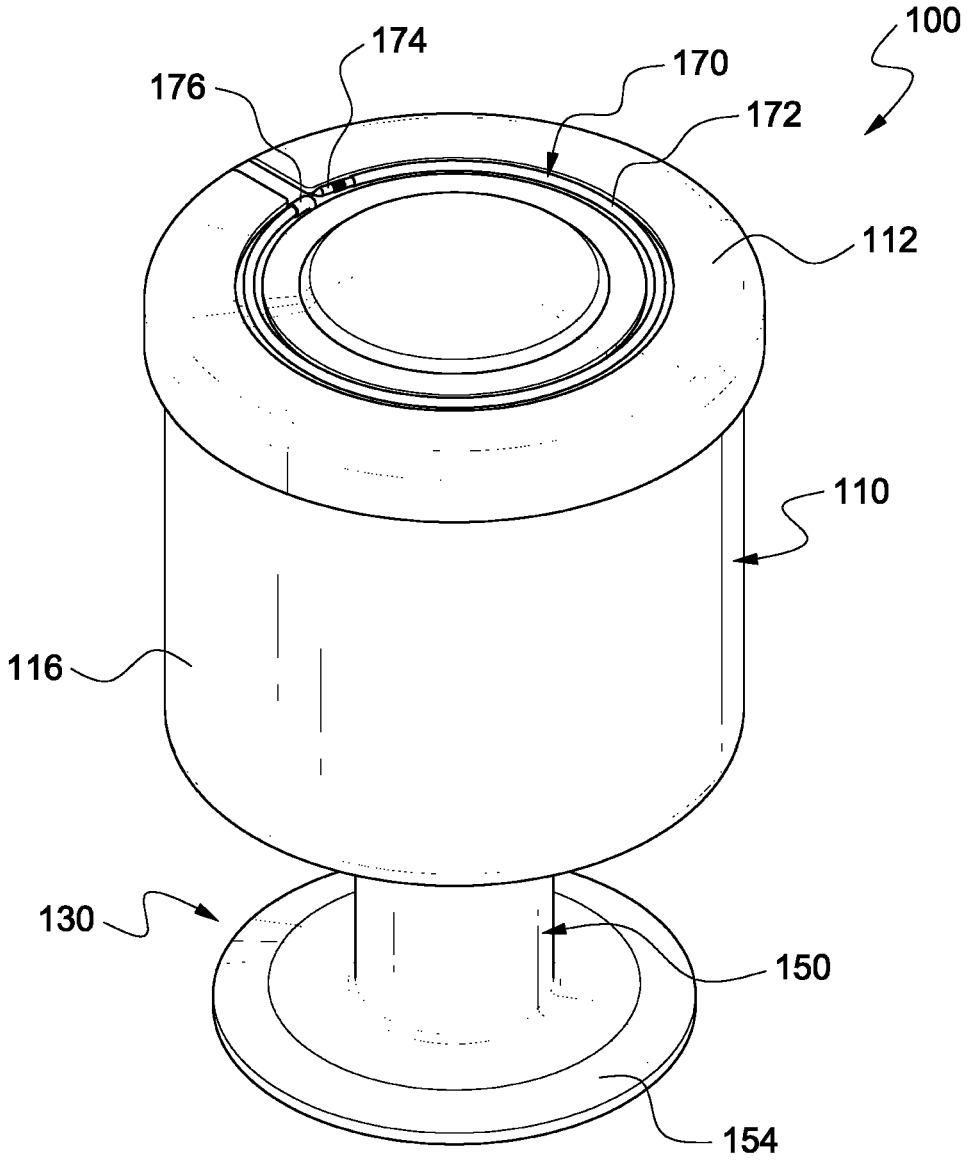

【Figure 18】
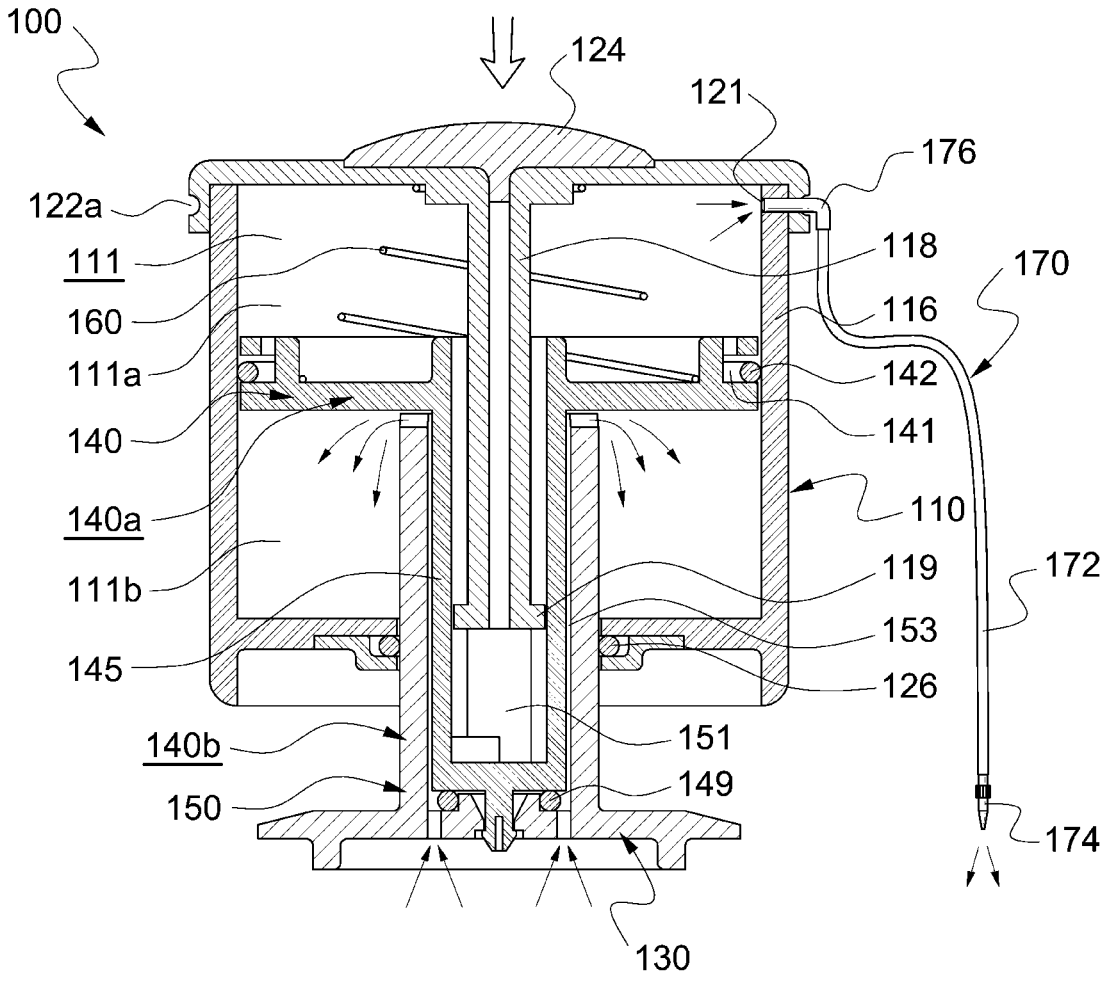

VACUUM APPARATUS

TECHNICAL FIELD

The present invention relates to an improvement of a vacuum apparatus, and more particularly to an improvement of a vacuum apparatus that may be properly used to discharge the air in a vacuum receptacle, which is used, for example, for storing food for a long period while maintaining the freshness of the food, to the outside so as to develop a negative pressure in the inside of the vacuum receptacle.

BACKGROUND ART

In general, in a vacuum state, it is possible to store food for a long period. Therefore, a vacuum receptacle that allows food to be stored in a vacuum state, and a vacuum apparatus that is capable of extracting the air in the vacuum receptacle to the outside as desired recently have been developed and used.

Such a vacuum apparatus is disclosed in detail in Korean Utility Model Registration No. 20-0343148 (hereinbelow, referred to be as the "prior art").

DISCLOSURE

Technical Problem

The inventor of the present invention has found that the vacuum apparatus of the prior art has a problem in that because a guide portion for guiding the ascent/descent of a second receptacle body is formed on the outside of the external wall of the second receptacle body, the amount of air to be taken in and discharged each time by the vacuum apparatus is small despite the large size of the vacuum apparatus, and thus the vacuum efficiency of the vacuum apparatus is poor.

Also, the inventor of the present invention has recognized that the vacuum apparatus has problems in that because the vacuum apparatus requires two receptacle bodies and the second receptacle is configured in a dual structure, the vacuum apparatus has a complicated construction and is difficult to fabricate, and raw materials are greatly required for manufacturing the vacuum apparatus.

In addition, the inventor of the present invention has recognized that the vacuum apparatus of the prior art is too simple in function for the complicated configuration thereof because the vacuum apparatus has only one function of taking in and discharging the air in the vacuum receptacle to the outside.

Furthermore, the inventor of the present invention has found that the vacuum apparatus of the prior art has a problem in that due to the triple side wall of the vacuum apparatus, when the dual wall of the second receptacle body and the wall of the first receptacle body overlap with each other, it is difficult to clearly confirm the operating condition in the inside thereof.

Accordingly, the present invention has been made to solve the above-mentioned problems occurring in the prior art, and an object of the present invention is to provide a vacuum apparatus that is simple in construction as compared to the vacuum apparatus of the prior art, and makes it needless to use two receptacle bodies.

Another object of the present invention is to provide a vacuum apparatus that allows more clear observation of the inside thereof.

Another object of the present invention is to provide a vacuum apparatus that requires a smaller amount of raw materials as compared to the vacuum apparatus of the prior art and is easy to fabricate.

Yet another object of the present invention is to provide a vacuum apparatus that allows a user to readily feel the discharge of air.

Still another object is to provide a vacuum apparatus that additionally has a function of inflating a ball, a balloon or the like.

Technical Solution

According to an aspect of the present invention, there is provided a vacuum apparatus including a cylinder member and a piston module. The cylinder module includes a top wall disposed on a top side of an inner space, a bottom wall disposed on a bottom side of the inner space to be spaced apart from the top wall, a side wall interconnecting the top wall and the bottom wall and surrounding a lateral side of the inner space, and a guide shaft extending downward from the top wall to be disposed in the central area of the inner space. The piston module includes a separating and opening/closing unit fitted in the inside of the cylinder member to be vertically movable and to separate the inner space of the cylinder member into an upper first space and a lower second space. The separating and opening/closing unit is provided with a first O-ring on an outer circumferential surface thereof to be in contact with the inner circumferential surface of the side wall so that the first O-ring opens/closes the first space and the second space in relation to each other while being moved vertically according to a moving direction in relation to the cylinder member. The piston module also includes a hollow rod unit extending downward from the central area of the separating and opening/closing unit such that a part of the hollow rod unit is exposed to the outside through the bottom wall. The hollow rod unit is formed with a guide bore in the inside thereof to accommodate the guide shaft therein to guide the ascent/descent of the guide shaft. The cylinder member is formed with a first vent hole that allows the air in the first space to be discharged to the outside while the first space is being reduced according to the descent of the cylinder member, and the hollow rod unit is formed with a second vent hole to communicate the second space with the outside. The bottom wall of the cylinder member is formed with a through-hole, through which the rod unit passes.

Preferably, a second O-ring is fitted in a peripheral edge of the through-hole to block a gap between the outer surface of the rod unit and the cylinder member, and a spring is installed in the first space to resiliently support the cylinder member and the separating and opening/closing unit between a top inner surface of the cylinder member and the separating and opening/closing unit.

A catch protrusion may be formed at a lower end of the guide shaft to protrude laterally, a concavity may be formed along an inner surface of the guide bore to be engaged with the catch protrusion in order to allow the catch protrusion to ascend/descend vertically, and a catch step may be formed at a lower end of the concavity in such a manner that the catch protrusion is caught by the catch step when the catch protrusion is rotated.

An outlet of the first vent hole, through which the air in the first space is discharged to the outside, is preferably formed on a top surface of the cylinder member.

A blocking prevention recess may be formed on the top surface of the cylinder member to be connected to the first vent hole so as to prevent a user's hand pressing the cylinder member from blocking the first vent hole.

A rubber mounting portion may be formed on a top surface of the cylinder member, and a silicon rubber may be mounted in the rubber mounting portion.

Preferably, a hose is connected to the first vent hole, and a nozzle is mounted at an end of the hose.

More preferably, a hose mounting recess is formed on an outer surface of the cylinder member such that the hose and the nozzle can be inserted into and mounted in the hose mounting recess.

The hollow rod unit includes: a hollow shaft portion extending downward from the central area of the separating and opening/closing unit and being formed with the guide bore in an inside thereof; and a tubular body provided with a through-hole at a bottom portion thereof, and fitted on an outer circumferential surface of the hollow shaft portion in such a manner that the second vent hole is formed between the tubular body and the inner circumferential surface of the hollow shaft portion.

Preferably, a catch protrusion is formed at the bottom surface of the hollow shaft portion, and a catch step is formed at the center of the lower end of the tubular body such that the catch protrusion is caught by the catch step. An O-ring is installed between the bottom surface of the hollow shaft portion and the bottom portion of the tubular body to block a gap between the bottom surface of the hollow shaft portion and the bottom portion of the tubular body, and to resiliently support the bottom surface of the hollow shaft portion and the bottom portion of the tubular body.

A wing portion extending laterally may be formed on an outer circumferential surface of the lower end of the rod unit, and a protrusion protruding downward may be formed along a closed path on a bottom surface of the wing portion.

Preferably, a first O-ring mounting recess in which the first O-ring is mounted to be moveable vertically is formed along the outer circumferential surface of the separating and opening/closing unit, and the first O-ring mounting recess and the first space are connected with each other through a through-hole.

More preferably, the cylinder member is formed from a transparent synthetic resin.

Advantageous Effects of Invention

According to the present invention, the side wall of the cylinder member is formed in a single wall, and the guide shaft and the guide bore that guide the ascent/descent of the cylinder member are formed to have a relatively small diameter. Therefore, a small amount of a raw material is required to fabricate the inventive vacuum apparatus as compared to the size of the vacuum apparatus. In addition, the inventive vacuum apparatus takes in and discharges a large amount of air each time by the vacuum apparatus, and thus the inventive vacuum apparatus is excellent in vacuum efficiency.

The inventive vacuum apparatus allows a mold required for fabricating the same to be reduced as compared to that for fabricating a conventional one.

The inventive vacuum apparatus requires a single receptacle body. Therefore, the vacuum apparatus does not have a complicated construction, and is easy to fabricate.

In some cases, the inventive vacuum apparatus may have a function for inflating a ball, a balloon, or the like in addition to the function of taking in and discharging the air in a vacuum receptacle to the outside.

According to the present invention, the cylinder member may be formed in a single wall. Therefore, the inventive vacuum apparatus allows the inside thereof to be clearly observed when the wall of the cylinder member is formed from a transparent material.

Furthermore, when the first vent hole is formed in the top wall of the cylinder member, the vacuum apparatus allows a user to readily feel the discharge of air.

DESCRIPTION OF DRAWINGS

The above and other objects, features and advantages of the present invention will be more apparent from the following detailed description taken in conjunction with the accompanying drawings, in which:

FIG. 1 is a perspective view illustrating an example of a vacuum apparatus according to the present invention;

FIG. 2 is an exploded perspective view of the vacuum apparatus illustrated in FIG. 1;

FIG. 3 is an exploded perspective view illustrating the vacuum apparatus illustrated in FIG. 1 in the bottom side;

FIG. 4 is a perspective view illustrating the vacuum apparatus in vertical cross-section;

FIG. 5 is a cross-sectional view illustrating the vacuum apparatus illustrated in FIG. 1 in a state where the vacuum apparatus is mounted on a vacuum receptacle;

FIG. 6 is a cross-sectional view illustrating the vacuum apparatus illustrated in FIG. 5 in a state in which the cylinder member of the vacuum apparatus is half lowered;

FIGS. 7 to 10 are cross-sectional views of the vacuum apparatus for describing a process of developing a negative pressure in a second space by pressing the cylinder member downward;

FIGS. 11 to 13 are cross-sectional views of the vacuum apparatus for describing a process of releasing the negative pressure developed in the second space as the cylinder member is raised by a spring to reduce the second space;

FIGS. 14 and 15 are perspective views illustrating a modified example of the inventive vacuum apparatus;

FIG. 16 is a perspective view illustrating another modified example of the inventive vacuum apparatus;

FIG. 17 is a perspective view illustrating a state where the hose and nozzle of FIG. 16 are accommodated in a hose mounting recess; and FIG. 18 is a cross-sectional view illustrating still another modified example of the inventive vacuum apparatus.

BEST MODE FOR CARRYING OUT THE INVENTION

Hereinafter, exemplary embodiments of the present invention will be described with reference to the accompanying drawings.

FIG. 1 is a perspective view illustrating an example of a vacuum apparatus according to the present invention, FIG. 2 is an exploded perspective view of the vacuum apparatus illustrated in FIG. 1, and FIG. 3 is an exploded perspective view illustrating the vacuum apparatus illustrated in FIG. 1 in the bottom side. FIG. 4 is a perspective view illustrating the vacuum apparatus in vertical cross-section, FIG. 5 is a cross-sectional view illustrating the vacuum apparatus illustrated in FIG. 1 in a state where the vacuum apparatus is mounted on a vacuum receptacle, and FIG. 6 is a cross-sectional view illustrating the vacuum apparatus illustrated in FIG. 5 in a state where the cylinder member of the vacuum apparatus is half lowered.

As illustrated in FIGS. 1 to 4, the vacuum apparatus 100 may be suitably used for increasing the vacuum level of a vacuum receptacle 10. Specifically, the vacuum apparatus 100 is mounted on a vacuum receptacle 10 which is provided with a check valve 16 as illustrated in FIGS. 5 and 6 to take in and discharge the air in the inside of the vacuum receptacle 10 to the outside, thereby increasing the vacuum level of the inside of the vacuum receptacle 10.

The vacuum receptacle 10 illustrated in FIGS. 5 and 6 is configured by a receptacle body 11 and a lid 15. The lid 15 includes: a lid body 15*a* having a seal mounting portion 17 formed along the peripheral edge of the bottom surface thereof and a check valve mounting portion 18 formed in the central area of the top surface thereof; a rubber seal 19 fitted on the seal mounting portion 17; and a check valve 16 installed in the check valve mounting portion 18.

As illustrated in FIGS. 1 to 6, the vacuum apparatus 100 according to the present invention generally includes: a cylinder member 110 that surrounds an inner space 111; a separating and opening/closing unit 140 that separates the inner space into an upper first space 111*a* and a lower second space 111*b* and opens or closes the first space 111*a* and second space 111*b* in relation to the other through a first O-ring 142; and a piston module 130 having a hollow rod unit 150 that extends downward from the central area of the separating and opening/closing unit 140.

The cylinder member 110 includes: a top wall 112 disposed on the top side of the inner space 111; a bottom wall 114 disposed on the bottom side of the inner space 111 to be spaced apart from the top wall 112; a side wall 116 that interconnects the top wall 112 and the bottom wall 114 and surrounds the lateral side of the inner space 111. Therefore, the top, bottom and lateral sides of the inner space 111 are enclosed. In addition, the cylinder member 110 of the vacuum apparatus 100 according to the present invention includes a guide shaft 118 that extends downward from the top wall 112 to be disposed in the central area of the inner space 111. The guide shaft 118 extends from the central area of the inner surface of the top wall 112 to the bottom wall 114.

Preferably, the cylinder member 110 is fabricated by forming the top wall 112 and the guide shaft 118 integrally, and the side wall 116 and the bottom wall 114 integrally, and then coupling the integrally formed ones to each other. In order to couple the top wall 112 and the side wall 116, screw coupling, tight fit, coupling using a resilient protrusion and a catch step, or welding may be selectively used.

The cylinder member 110 having the guide shaft 118 disposed in the central area of the inner space 111 is the major characteristic feature that distinguishes the present invention from a conventional one. The cylinder member 110 allows the size of the inner space 111 to be increased as compared to a conventional vacuum apparatus so that the amount of air to be taken in can be increased, and allows the amount of a raw material required for manufacturing the vacuum apparatus to be reduced. In addition, the cylinder member 110 allows the size of a mold used for manufacturing the cylinder member to be reduced.

At the lower end of the guide shaft 118, a protrusion 119 is formed to laterally protrude. The protrusion 119 is provided so as to allow the cylinder member 110 to be caught by a catch step 152 formed inside the rod unit 150 by rotating the cylinder member 110 in a state where the cylinder member 110 is lowered and thus the vacuum apparatus 100 is retracted. In this manner, the vacuum apparatus 100 may be maintained in the retracted state.

As can be seen from FIGS. 1 to 6, the cylinder member 110 is provided with at least one first vent hole 121 configured to allow the first space 111*a* in the upper side of the separating and opening/closing unit 140 to be communicated with the outside so that the ambient air can freely flow into or flow out from the first space 111*a*. The first vent hole 121 is preferably formed at a position higher than the top dead-center of the first O-ring 142 of the separating and opening/closing unit 140, and more preferably formed in the top wall 112. When the first vent hole 121 is formed in the top wall 112, the outlet of the first vent hole 121, through which the air in the first space 111*a* is discharged to the outside, is oriented upward in relation to the cylinder member 110. In this case, the air discharged from the first space 111*a* to the outside is ejected in the vicinity of the user's hand operating the vacuum apparatus 100. Therefore, the user may feel the discharge of air when operating the vacuum apparatus 100.

In some cases, the first vent hole 121 may be formed at a position slightly lower than the top dead center of the first O-ring 142 of the separating and opening/closing unit 140 (within about 10 mm below from the top dead center). In such a case, the first space 111*a* is closed from the instant when the separating and opening/closing unit 140 passes over the first vent hole 121 while the separating and opening/closing unit 140 is being raised. Therefore, it is possible to prevent the cylinder member 110 from being rapidly lowered to collide with the piston module 130. As such, the user may apply a great force to the cylinder member 110 with an easy mind.

As illustrated in FIGS. 1 to 6, a blocking prevention recess 122 connected to the first vent hole 121 is formed on the top surface of the cylinder member 110 so that the user's hand cannot block the first vent hole 121 when pressing the cylinder member 110. The blocking prevention recess 122 is provided in order to ensure that the first vent hole 121 is not blocked by the user's hand even when the user's hand is positioned on the top of the first vent hole 121.

In addition, a rubber mounting portion 123 is formed on the top surface of the cylinder member 110, and a silicon rubber 124 is mounted in the rubber mounting portion 123 so that a good feeling is relayed to the user when pressing the cylinder member 110.

In the bottom wall 114 of the cylinder member 110, a through-hole 125, through which the rod unit 150 passes, is formed, and a second O-ring 126 is fit on the peripheral edge on the bottom side of the through-hole 125 through a second O-ring fit unit 127 so as to block a gap between the outer surface of the rod unit 150 and the cylinder member 110.

A piston module 130 coupled to the cylinder member 110 as described above includes the separating and opening/closing unit 140 that separates the inner space 111 of the cylinder member 110 into the first space 111*a* and the second space 111*b*, and the hollow rod unit 150 that extends downward from the central area of the separating and opening/closing unit 140.

The separating and opening/closing unit 140 may ascend/descend vertically with respect to the cylinder member 110. A first O-ring mounting recess 141 is formed along the outer circumferential surface of the separating and opening/closing unit 140. A first O-ring 142 is installed in the first O-ring mounting recess 141 in such a manner that the first O-ring 142 may be movable vertically in a state where it is in contact with the inner surface of the side wall 116. The size of the vertical height of the first O-ring mounting recess 141 is larger than the diameter of the first O-ring 142 so that the first O-ring 142 is vertically movable in the first O-ring mounting recess 141. The first O-ring mounting recess 141 is connected with the first space 111*a* through the through-hole 141*a*.

As a result, the separating and opening/closing unit 140 serves to block the first space 111*a* and the second space 111*b* in relation to the each other only when the separating and opening/closing unit 140 is moved in one direction. That is, when the cylinder member 110 is lowered, the first O-ring 142 is moved downward, thereby closing a gap between the separating and opening/closing unit 140 and the inner circumferential surface of the side wall 116 of the cylinder member 110, and when the cylinder member 110 is raised, the first O-ring 142 is moved upward, thereby opening the gap between the separating and opening/closing unit 140 and the inner circumferential surface of the side wall 116 of the cylinder member 110 so that the first space 111*a* and the second space 111*b* are communicated with each other through the through-hole 141*a*.

The hollow rod unit 150 is formed on the bottom side of the separating and opening/closing unit 140. The rod unit 150 extends downward from the central area of the separating and opening/closing unit 140. A part of the rod unit 150 is exposed to the outside through the through-hole 125 formed in the bottom wall 114 of the cylinder member 110. A guide bore 151 is formed inside the rod unit 150. The guide bore 151 is configured to accommodate the guide shaft 118 to guide the ascent/descent of the guide shaft 118. The guide bore 151 has a concavity 151*a* formed to extend vertically so that the protrusion 119 formed at the bottom end of the guide shaft 118 can be raised or lowered. Also, a catch step 152 is formed at the bottom end of the guide bore 151 so that the protrusion 119 can be caught by the catch step 152 when the protrusion 119 is rotated in the state where the protrusion 119 is lowered to that height.

In addition, a second vent hole 153 is formed inside the rod unit 150 to allow the second space 111*b* and the outside to be communicated with each other. The second vent hole 153 is provided to ensure that the air in the inside of the vacuum receptacle 10 opens the check valve 16 and escapes to the outside and the air is taken into the inside of the second space 111*b* when a negative pressure is developed in the second space 111*b* in a state where the bottom end of the rod unit 150 blocks the area around the check valve 16 provided in the lid 15 of the receptacle 10 from the outside.

The piston module 130 may be preferably fabricated by coupling a main body 140*a* having the separating and opening/closing unit 140 and the hollow shaft portion 145 that extends downward from the center of the separating and opening/closing unit 140 and is formed with the guide bore 151 in the inside thereof, and a tubular body 140*b* fitted on the outer circumferential surface of the hollow shaft portion 145. In this case, if the inner diameter of the tubular body 140*b* is slightly larger than the outer diameter of the hollow shaft portion 145, the second vent hole 153 that communicates the second space 111*b* with the outside is naturally formed between the outer circumferential surface of the hollow shaft portion 145 and the inner circumferential surface of the tubular body 140*b*, and the piston module 130 can be conveniently assembled with the cylinder member 110.

In this case, it is more preferable to form a catch protrusion 147 on the bottom surface of the main body 140*a*, and to form a catch step 148 at a position corresponding to the catch protrusion 147, that is, at the center of the bottom end of the tubular main body 140*a* in such a manner that the catch protrusion 147 is inserted into and caught by the catch step 148, so that the main body 140*a* and the tubular body 140*b* can be coupled to each other through the catch protrusion 147*a* and the catch step 148*a*. Of course, it is necessary to form a through-hole 153*a* in the bottom portion of the tubular body 140*b* so as to form the second vent hole 153. In addition, in order to prevent the air introduced into the inside of the rod unit 150 through the through-hole 153*a* from escaping the gap between the catch protrusion 147 and the catch step 148, an O-ring 149 may also be installed between the tubular body 140*b* and the hollow shaft portion 145. In this case, the O-ring 149 is resiliently engaged between the hollow shaft portion 145 and the tubular body 140*b* to support the hollow shaft portion 145 and the tubular body 140*b*, thereby allowing the hollow shaft portion 145 and the tubular body 140*b* to be easily coupled to each other as well as preventing the hollow shaft portion 145 and the tubular body 140*b* from being moved in relation to each other in the coupled state.

A wing portion 154 may be formed on the outer circumferential surface of the lower end of the tubular body 140*b* to extend laterally, and a protrusion 156 may be formed on the bottom surface of the a wing portion 154 along a closed path to protrude downward. Since the wing portion 154 and the protrusion 156 are provided to close the space around the check valve 16 mounted in the lid 15, they may be variously modified according to the configuration of the portion of the lid 15 around the check valve 16. When the piston module 130 according to the present invention is used for a vacuum receptacle in which the sizes of the check valve 16 and the recess formed therearound are small, the piston module 130 may be fabricated without the wing portion 154 and the protrusion 156.

As illustrated in FIGS. 1 to 6, a spring 160 is provided in the first space 111*a* to resiliently support the cylinder member 110 and the separating and opening/closing unit 140 therebetween. The spring 160 serves to allow the cylinder member 110 to be returned upward when an external force is removed after the cylinder member 110 has been moved downward by the external force.

FIGS. 7 to 10 are cross-sectional views of the vacuum apparatus for describing a process of developing a negative pressure in the second space by pressing the cylinder member downward, and FIGS. 11 to 13 are cross-sectional views of the vacuum apparatus for describing a process of releasing the negative pressure developed in the second space as the cylinder member is raised by a spring to reduce the second space.

The operating process of the vacuum apparatus according to the present invention will be described with reference to FIGS. 7 to 13 as well as with reference to FIGS. 1 to 6 referred to in the above description.

First, the vacuum apparatus 100 in the state illustrated in FIG. 7 is mounted on the check valve mounting portion 18 in the lid 15 of the vacuum receptacle 10 as illustrated in FIG. 5 in such a manner that the space around the check valve 16 is surrounded by the wing portion 154 and the protrusion 156 formed on the bottom surface of the wing portion 154. In this state, the first O-ring 142 of the piston module 130 is positioned at the bottom dead center. In this state, the user may press the cylinder member 110 downward by hand.

The cylinder member 110 starts descending while being guided by the guide bore 151 through the guide shaft 118, and the first O-ring 142 positioned in the top side of the first O-ring mounting recess 141 is moved downward by the inner surface of the side wall 116 as illustrated in FIG. 8, thereby blocking a gap between the outer periphery of the separating and opening/closing unit 140 and the inner circumferential surface of the side wall 116, thereby preventing air from flowing through the gap. In addition, as the cylinder member 110 descends, the first space 111*a* is gradually reduced, and the second space 111*b* is gradually increased. As a result, a negative pressure is developed in the second space 111*b*.

As the air around the check valve 16 is taken into the second space 111*b* through the second vent hole 153, a negative pressure is also developed in the space around the check valve 16, and the check valve 16 is opened. Accordingly, the air in the inside of the vacuum receptacle 10 escapes to the outside of the check valve 16 and then flows into the second space 111*b* through the second vent hole 153 as illustrated in FIGS. 6 and 9.

Meanwhile, the air existing in the first space 111*a* escapes to the outside of the cylinder member 110 through the first vent hole 121, and the spring 160 is gradually retracted.

When the cylinder member 110 is fully pressed downward, the cylinder member 110 descends to the lowest position as illustrated in FIG. 10. As a result, the first space 111*a* is reduced as much as possible, the second space 111*b* is increased as much as possible, and the first O-ring 142 of the piston module 130 is positioned at the top dead center. In this state, the first O-ring 142 is positioned at the lowest position in the first O-ring mounting recess 141.

When the external force applied to the cylinder member 110 in the state illustrated in FIG. 10 is removed, the cylinder member 110 starts ascending by the elastic force of the spring 160, and the first O-ring 142 contacted with the side wall 116 ascends as illustrated in FIG. 11 by the cylinder member 110, thereby opening the gap between the outer periphery of the separating and opening/closing unit 140 and the inner circumferential surface of the side wall 116. Accordingly, the air in the second space 111*b* moves to the first space 111*a*, and ambient air flows into the first space 111*a* through the first vent hole 121. Therefore, the first space 111*a* is gradually increased and the second space 111*b* is gradually reduced. In this manner, the cylinder member 110 ascends to the medium height as illustrated in FIG. 12, then ascends to the highest height as illustrated in FIG. 13, and then returns to its initial state as illustrated in FIG. 7.

That is, when the process of FIGS. 7 to 13 is repeated in the state where the vacuum apparatus 100 according to the present invention is mounted on the lid of the vacuum receptacle 10, the inside of the vacuum receptacle 10 may be turned into a high vacuum state.

When it is desired to store the vacuum apparatus 100 by reducing the entire length thereof, it is possible to lower and rotate the cylinder member 110 in relation to the piston module 130 in such a manner that the protrusion 119 formed at the lower end of the guide shaft 118 is caught by the catch step 152, and then to store the vacuum apparatus. When it is desired to use the vacuum apparatus again, it is possible to rotate the cylinder member 110 in the direction opposite to the initial rotating direction in such a manner that the protrusion 119 is released from the catch step 152 to raise the cylinder member 110 as illustrated in FIG. 13, and then to use the vacuum apparatus.

Mode for Invention

FIGS. 14 and 15 are perspective views illustrating a modified example of the inventive vacuum apparatus.

Occasionally, the vacuum apparatus 100 according to the present invention may be configured in such a manner that the cylinder member 110, the separating and opening/closing unit and the first O-ring of the piston module 130, etc. are formed in an oval shape as can be seen from FIG. 14, so that the user can easily grasp the vacuum apparatus 100 by hand.

In some cases, the vacuum apparatus 100 may be configured in such a manner that the top wall 112 is formed in an octagonal shape as illustrated in FIG. 15.

The top wall 112 or the like may be formed in other shapes including a hexagonal shape.

The remaining features are the same as those described with reference to FIGS. 1 to 13.

When the entirety of the cylinder member 110 or components such as top wall 112 of the cylinder member 110 are formed in a shape other than the circular shape as illustrated in FIGS. 14 and 15, there is an advantage in that the vacuum apparatus 100 does not roll around even when the vacuum apparatus is turned on its side although it becomes somewhat difficult to fabricate the vacuum apparatus.

In addition, the cylinder member 110 of the vacuum apparatus 100 according to the present invention may be formed from a transparent material. In the vacuum apparatus 100 according to the present invention, the side wall 116 of the cylinder member 110 is configured by a single wall. Therefore, when the side wall 116 is formed from a transparent material, it is possible to more clearly observe the inside of the cylinder member 110 as compared to a conventional one. As for the transparent material, a synthetic resin is suitable.

FIG. 16 is a perspective view illustrating another modified example of the inventive vacuum apparatus, and FIG. 17 is a perspective view illustrating a state where the hose and the nozzle of FIG. 16 are accommodated in a hose mounting recess.

In some cases, the vacuum apparatus 100 according to the present invention may be configured such that an air injection assisting unit 170 may be installed in the first vent hole 121. The air injection assisting unit 170 may include a hose 172 connected to the first vent hole 121, a nozzle 174 installed at an end of the hose 170, and a connector 176 for connecting the hose 172 to the first vent hole 121. As for the connector 172, an L-shaped tube formed with threads on the outer circumferential surface thereof may be suitable. However, other components may be employed as long as they connect the hose 172 to the first vent hole 121. Occasionally, the connector 172 may be formed integrally with the cylinder member 110.

The inventive vacuum apparatus 100 including the air injection assisting unit 170 as described above may be used for inflating a balloon, a football, a basketball or the like. In such a case, it is desirable to form a single first vent hole 121, and when a plurality of first vent holes 121 are formed, it is required to configure the holes 121 other than one hole to be readily blocked as desired. In addition, the blocking prevention recess 122 may be used as a hose mounting recess for accommodating the hose 172 and the nozzle 174 as illustrated in FIG. 17.

The remaining features are the same as those described with reference to FIGS. 1 to 13.

FIG. 18 is a cross-sectional view illustrating still another modified example of the inventive vacuum apparatus.

Occasionally, the first vent hole 121 may be formed in the side wall 116 of the cylinder member 110 as illustrated in FIG. 18. In this case, the first vent hole 121 may be preferably formed above the top dead center of the cylinder module 130.

In this case, the vacuum apparatus 100 may be configured in such a manner that the air injection assisting unit 170 is connected to the first vent hole 121, and the hose mounting recess 122*a* is formed along the outer circumference of the side wall 116. The air injection assisting unit 170 is connected to the first vent hole 121 through the connector 176, and the hose 172 and the nozzle 174 installed at the end of the hose 172 may be used for inflating a ball, a balloon or the like.

The remaining features are the same as those described with reference to FIGS. 1 to 13, 16 and 17.

INDUSTRIAL APPLICABILITY

The present invention may be used for fabricating a vacuum apparatus for discharging and evacuating a sealed receptacle or for fabricating an air injection pump that may be also used as a vacuum apparatus.

The invention claimed is:

1. A vacuum apparatus comprising:

a cylinder member including a top wall disposed on a top side of an inner space, a bottom wall disposed on a bottom side of the inner space to be spaced apart from the top wall, a side wall interconnecting the top wall and the bottom wall and surrounding a lateral side of the inner space, and a guide shaft extending downward from the top wall to be disposed in a central area of the inner space; and a piston module including a separating and opening/closing unit fitted in the inside of the cylinder member to be vertically movable and to separate the inner space of the cylinder member into an upper first space and a lower second space, the separating and opening/closing unit being provided with a first O-ring on an outer circumferential surface thereof to be in contact with an inner circumferential surface of the side wall so that the first O-ring opens/closes the first space and the second space in relation to each other while being moved vertically according to a moving direction in relation to the cylinder member, and a hollow rod unit extending downward from a central area of the separating and opening/closing unit in such a manner that a part of the hollow rod unit is exposed to an outside through the bottom wall, the hollow rod unit being formed with a guide bore in the inside thereof to accommodate the guide shaft therein to guide an ascent/descent of the guide shaft, wherein the cylinder member is formed with a first vent hole that allows the air in the first space to be discharged to the outside while the first space is being reduced according to the descent of the cylinder member, and the hollow rod unit is formed with a second vent hole to communicate the second space with the outside, and wherein the bottom wall of the cylinder member is formed with a through-hole, through which the hollow rod unit passes, wherein the hollow rod unit includes: a hollow shaft portion extending downward from the central area of the separating and opening/closing unit and being formed with the guide bore in an inside thereof; and a tubular body provided with a through-hole at a bottom portion thereof, and fitted on an outer circumferential surface of the hollow shaft portion in such a manner that the second vent hole is formed between the tubular body and the outer circumferential surface of the hollow shaft portion, and wherein a catch protrusion is formed on a bottom surface of the hollow shaft portion, a catch step is formed at a center of the lower end of the tubular body such that the catch protrusion is caught by the catch step, and an O-ring is installed between the bottom surface of the hollow shaft portion and the bottom portion of the tubular body to block a gap between the bottom surface of the hollow shaft portion and the bottom portion of the tubular body, and to resiliently support the bottom surface of the hollow shaft portion and the bottom portion of the tubular body therebetween.

2. The vacuum apparatus as claimed in claim 1, wherein a second O-ring is fitted on a peripheral edge of the through-hole to block a gap between the outer surface of the hollow rod unit and the cylinder member, and a spring is installed in the first space to resiliently support the cylinder member and the separating and opening/closing unit between a top inner surface of the cylinder member and the separating and opening/closing unit.

3. The vacuum apparatus as claimed in claim 1, wherein a catch protrusion is formed at a lower end of the guide shaft to protrude laterally, a concavity is formed along an inner surface of the guide bore to be engaged with the catch protrusion in order to allow the catch protrusion to ascend/descend vertically, and a catch step is formed at a lower end of the concavity in such a manner that the catch protrusion is caught by the catch step when the catch protrusion is rotated.

4. The vacuum apparatus as claimed in claim 1, wherein an outlet of the first vent hole, through which the air in the first space is discharged to the outside, is formed on a top surface of the cylinder member.

5. The vacuum member as claimed in claim 4, wherein a blocking prevention recess is formed on the top surface of the cylinder member to be connected to the first vent hole so as to prevent a user's hand pressing the cylinder member from blocking the first vent hole.

6. The vacuum member as claimed in claim 1, wherein a rubber mounting portion is formed on a top surface of the cylinder member, and a silicon rubber is mounted in the rubber mounting portion.

7. The vacuum apparatus as claimed in claim 1, wherein a hose is connected to the first vent hole, and a nozzle is mounted at an end of the hose.

8. The vacuum apparatus as claimed in claim 7, wherein a hose mounting recess is formed on an outer surface of the cylinder member such that the hose and the nozzle can be inserted into and mounted in the hose mounting recess.

9. The vacuum apparatus as claimed in claim 1, wherein a wing portion extending laterally is formed on an outer circumferential surface of a lower end of the hollow rod unit, and a protrusion protruding downward is formed along a closed path on the bottom surface of the wing portion.

10. The vacuum apparatus as claimed in claim 1, wherein a first O-ring mounting recess in which the first O-ring is mounted to be moveable vertically is formed along the outer circumferential surface of the separating and opening/closing unit, and the first O-ring mounting recess and the first space are connected with each other through a through-hole.

11. The vacuum apparatus as claimed in claim 1, wherein the cylinder member is formed from a transparent synthetic resin.

* * * * *